US011703802B2

(12) United States Patent
Avril et al.

(10) Patent No.: US 11,703,802 B2
(45) Date of Patent: Jul. 18, 2023

(54) DEVICE FOR CONTROLLING A TIMEPIECE

(71) Applicant: MECO SA, Grenchen (CH)

(72) Inventors: Hervé Avril, Les Breuleux (CH); Gregory Kissling, La Neuveville (CH); Rémy Thiry, Maiche (FR); Valon Hoti, Bienne (CH); Samuel Geiser, Bienne (CH)

(73) Assignee: MECO SA, Grenchen (CH)

( * ) Notice: Subject to any disclaimer, the term of this patent is extended or adjusted under 35 U.S.C. 154(b) by 156 days.

(21) Appl. No.: 17/399,316

(22) Filed: Aug. 11, 2021

(65) Prior Publication Data

US 2022/0206435 A1 Jun. 30, 2022

(30) Foreign Application Priority Data

Dec. 31, 2020 (EP) ..... 20217969

(51) Int. Cl.
*G04B 3/04* (2006.01)
*G04B 37/06* (2006.01)

(52) U.S. Cl.
CPC ..... *G04B 3/046* (2013.01); *G04B 3/045* (2013.01); *G04B 37/06* (2013.01)

(58) Field of Classification Search
CPC ..... G04B 3/045; G04B 3/046; G04B 37/06; G04B 3/043; G04B 37/103; G04B 27/023; G04B 27/026; G04B 19/24; G04B 3/041; G04B 37/10
See application file for complete search history.

(56) References Cited

U.S. PATENT DOCUMENTS

| | | | | |
|---|---|---|---|---|
| 10,915,067 | B2 * | 2/2021 | Buehler | G04B 3/041 |
| 11,042,122 | B2 * | 6/2021 | Iguchi | G04B 3/041 |
| 2004/0090873 | A1 * | 5/2004 | Damasko | G04D 1/025 368/319 |
| 2013/0114383 | A1 * | 5/2013 | Gourdin | G04B 3/04 368/308 |

FOREIGN PATENT DOCUMENTS

| | | |
|---|---|---|
| EP | 2 827 202 A2 | 1/2015 |
| FR | 2 783 939 A1 | 3/2000 |

OTHER PUBLICATIONS

European Search Report for EP 20 21 7969 dated May 31, 2021.

* cited by examiner

*Primary Examiner* — Edwin A. Leon
(74) *Attorney, Agent, or Firm* — Sughrue Mion, PLLC

(57) ABSTRACT

A timepiece incudes a crown (4) housed in a cavity (10) provided in the case and open towards the outside, such as a cavity (10) in the side wall of the case (1) of a wristwatch, in the rest position of the crown (4). To bring the crown out of its rest position, the user rotates a rotary knurling-roller (5). The knurling-roller (5) is coupled to a tube (15) wherein is inserted a crown body (18) integral with the crown. The rotation of the knurling-roller actuates rotation as well as translation of the tube, which is linked only in translation to said cylinder (18). The tube displaces the crown in an axial direction without rotating the crown around its central axis (6). At least one control position of the crown and the rod can be reached, by rotating the knurling-roller (5) without having to manually pull the crown outwards.

15 Claims, 7 Drawing Sheets

DEVICE FOR CONTROLLING A TIMEPIECE

CROSS-REFERENCE TO RELATED APPLICATIONS

This application claims priority to European Patent Application No. 20217969.3 filed Dec. 31, 2020, the entire contents of which are incorporated herein by reference.

TECHNICAL FIELD

The invention relates to a device for controlling a timepiece, such as a wristwatch, in particular a wristwatch including a mechanical movement.

TECHNOLOGICAL BACKGROUND

The adjustment and/or winding of a mechanical watch is conventionally carried out by a control crown which can be operated in rotation and in traction, generally located at the 3 o'clock position around the periphery of the watch. The crown is integral with a control rod which can be displaced axially in several axial positions corresponding to each function to be operated, such as manual winding of the movement, setting the time, setting the date and/or adjusting other indicators displacing above or below the watch dial.

The control crown which is projecting from the watch case sometimes needs to be protected, for example to avoid causing by catching the sudden engagement of a function, or worse the deterioration of the winding rod. To overcome this disadvantage, watches provided with crowns embedded into the wall of the case have been designed in order to protect it from the risks of impact to which it is exposed. However, access to this type of crown is not always easy for the user, particularly when it comes to pulling the crown to displace it to its various axial positions for controlling the various functions.

SUMMARY OF THE INVENTION

The invention aims at solving the above mentioned problems.

To this end, the invention provides a timepiece comprising a case, a mechanical or electronic movement disposed in the case, and a crown rotatably coupled to a control rod passing through a wall of the case so as to actuate at least one function of the timepiece by the rotation of the control rod around its central axis, said rotation being carried out by rotating the crown, the timepiece being characterised in that:

- the case is provided with a rotary knurling-roller provided with a bore which is central and coaxial with the central axis, and operable in rotation about said central axis, the knurling-roller being mounted on the case so as to be stationary in the axial direction,
- the crown is integral with a cylindrical crown body disposed inside a tube, the crown body and the tube being coaxial with the central axis,
- the tube passes through the bore of the knurling-roller and is coupled to the rotary knurling-roller so that the rotation of the knurling-roller causes a rotation of the tube around the central axis, as well as a translation of the tube in the axial direction,
- the crown is free to rotate relative to the tube,
- the crown is arranged to be integral in translation with the tube in the axial direction, so that the rotation of the knurling-roller causes a translation of the crown in the direction of the central axis, the crown being driven by the translation of the tube, between a rest position according to which the crown is housed in a cavity provided in said wall of the case, and at least one control position wherein the crown is projecting from said wall, thus allowing actuation of said at least one function.

Thus, a timepiece according to the invention comprises a crown which can be housed in a cavity provided in the case of the timepiece and open towards the outside, such as a cavity in the side wall of the case of a wristwatch, so that the crown is housed entirely in the cavity or flush with the side wall when it is not in use, that is to say in the rest position of the crown.

To bring the crown out of its rest position, the user will rotate a fixed rotary knurling-roller in the axial direction of the crown. Preferably, the knurling-roller is accessible from the top of the case.

The knurling-roller is coupled to a tube wherein is inserted a cylindrical crown body integral with the crown. The rotation of the knurling-roller causes a rotation as well as a translation of the tube, which is linked only in translation to said cylinder. In other words, the tube displaces the crown in an axial direction without rotating the crown around its central axis.

As in known control devices, the crown is rotatably coupled to a control rod to actuate one or more functions of the movement of the timepiece, depending on the axial position of the rod.

The invention allows to reach at least one control position of the crown and the rod, by rotating the knurling-roller, therefore without manually pulling the crown outwards.

In the control positions, the crown is projecting from the wall, which allows to rotate the crown manually as in the existing control devices. To displace the crown to its rest position, the user will rotate the knurling-roller in the opposite direction.

The coupling between the tube and the knurling-roller can be achieved by a thread connection.

According to some embodiments, this connection is configured to control the displacement of the crown to all the control positions available to adjust various functions of a horological movement. More particularly and according to a preferred embodiment, the thread connection is formed between an internal thread which extends over a length of the central bore of the knurling-roller and an external thread which extends over the entire length of the tube or over part of said length of the tube, thus allowing to reach several control positions without losing the coupling by said thread connection between the tube and the knurling-roller.

According to other embodiments, the connection only allows to reach a part of the control positions, the other positions being able to be reached by manually pulling the crown. More particularly and according to a preferred embodiment, the thread connection is formed between an internal thread which extends at least over part of the length of the central bore of the knurling-roller and an external thread which extends over a limited portion of the length of the tube, so that the coupling between the knurling-roller and the tube is lost when the crown reaches one of the control positions from the rest position, and in that the coupling can be restored by pushing the crown manually towards the inside of the case then by rotationally actuating the knurling-roller. According to another embodiment, the connection between the tube and the knurling-roller is made by a helical profile provided on the outer surface of the tube, cooperating with a plurality of radial pins fixed inside the knurling-roller. More particularly and according to a preferred embodiment, the tube is provided with a helical profile on its outer surface, said profile defining a groove extending like a helix along said tube, the knurling-roller is provided with one or more pins oriented radially relative to the surface of the central bore of the knurling-roller and disposed in a single plane perpendicular to the central axis, the pins enter said groove, so that the rotation of the knurling-roller in either direction of rotation causes a rotation of the tube as well as a translation of the tube in either axial direction. Preferably, the pins are mounted in a shroud driven inside the central bore of the knurling-roller.

According to one feature of the invention, the cylinder crown body forms a hollow cylinder with an internal section of polygonal shape, and an end part of the control rod is disposed inside said hollow cylinder, said end part of the control rod comprising a portion with a polygonal section corresponding to the internal section of the hollow cylinder, the control rod being disposed so that during the translation of the crown between the rest position and a first control position projecting from the wall, the rod remains stationary relative to the case.

According to one feature of the invention, the control rod is disposed so that when the crown displaces in translation beyond the first control position, the rod is driven with the crown to one or more different control positions.

According to one feature of the invention, a spring is disposed between a shoulder of the control rod and the crown head.

According to one feature of the invention, the knurling-roller is provided at its outer periphery with one or more markings indicating one or more angular positions of the knurling-roller which correspond respectively to one or more control positions of the rod.

According to a preferred embodiment of the invention, the timepiece is a wristwatch with mechanical movement and manual winding.

According to a preferred embodiment of the invention, the first control position allows manual winding of the movement, and in that a second control position allows the hours and minutes to be adjusted.

According to a preferred embodiment of the invention, the crown is flush with the wall of the case when the crown is in the rest position.

According to another preferred embodiment of the invention, the wall of the case comprises a through housing extending perpendicularly to the cavity housing the crown and facing the latter and the knurling-roller is disposed in this housing.

The invention thus allows to house the crown in a cavity provided in a watch case, so that the crown does not disturb the user of the watch when it is in its rest position, and to bring the crown out of its rest position without manually pulling the crown outwards.

BRIEF DESCRIPTION OF THE FIGURES

The invention will be described in more detail below using the appended drawings, given by way of non-limiting examples, wherein.

DETAILED DESCRIPTION OF THE INVENTION

Figure 1:
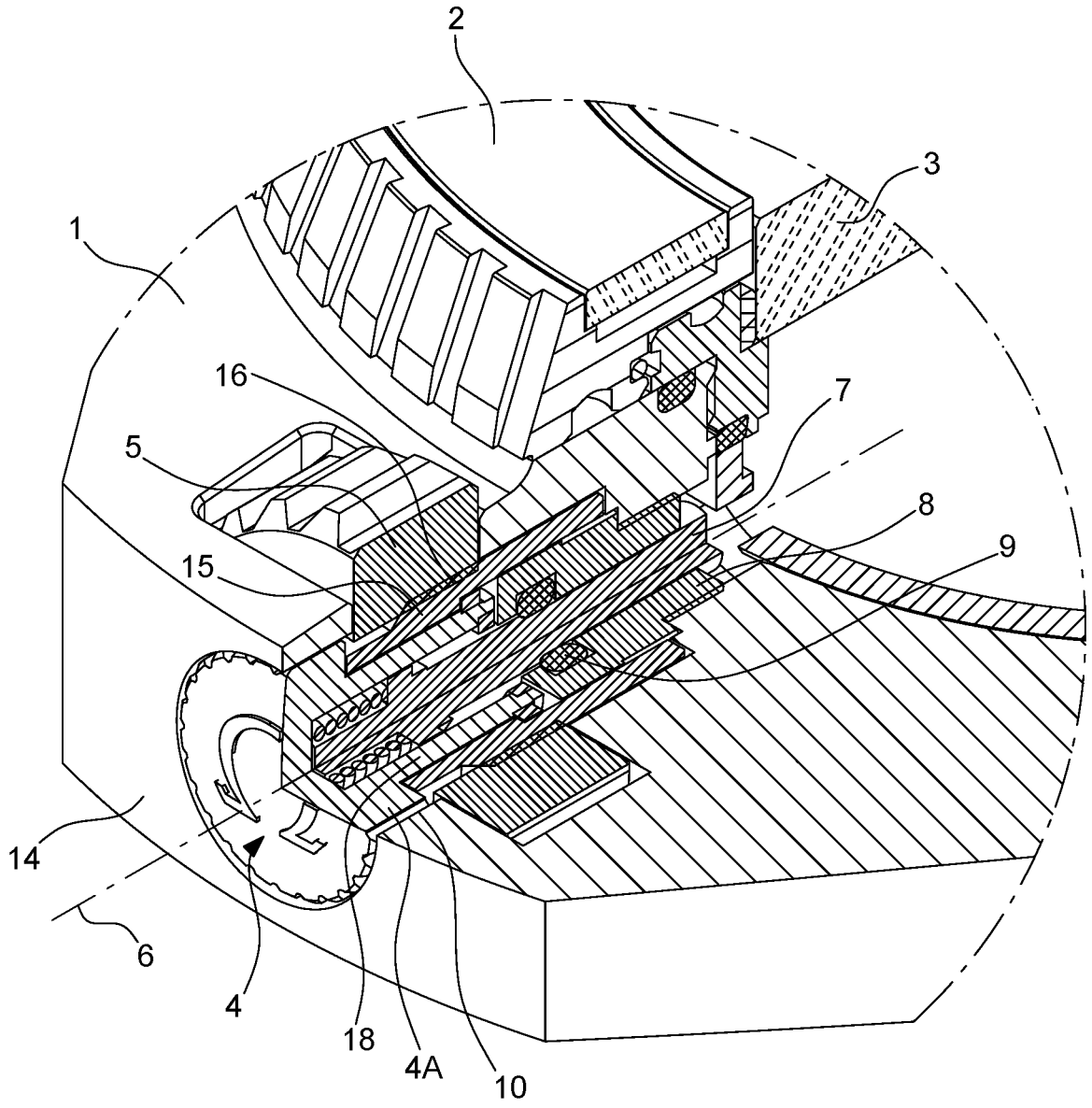
FIG. 1 shows a 3D section of the control device of a watch according to a first embodiment.

A first embodiment of a wristwatch according to the invention is illustrated in FIGS. 1 and 2*a* to 2*d* which show a control device incorporated in the case 1 of the watch. The case 1 contains a mechanical horological movement not shown in the figure but which can also be an electronic or electromechanical horological movement known in the prior art. A portion of the bezel 2 and of the crystal 3 of the watch are also seen. The control device comprises a crown 4 formed of a crown head 4*a* and a hollow cylindrical crown body 18 which is housed in a cavity 10 open towards the outside and provided in the side wall 14 of the case 1. In the condition shown in FIG. 1, the ring 4 is flush with the surface of the wall 14. This condition represents the current rest state of the control device, when the device is not used by the watch user. The crown 4 could also be housed entirely in the cavity 10 instead of being flush with the wall 14.

To actuate the control device, the user will rotate a rotary knurling-roller 5 provided with a central bore and, disposed coaxially with the axis of rotation 6 of the crown 4, and an upper part of which is accessible to the user from the top of the case 1. The knurling-roller 5 is free to rotate around the axis 6 and stationary in the axial direction of the crown 4. The axis of rotation 6 of the crown coincides with the central axis of a control rod 7 able to cooperate with a movement mechanism, in a manner known per se and not detailed in the present context. The control rod 7 is guided inside a fixed shouldered sleeve 8, screwed into a wall of the case 1 of the watch at the bottom of the cavity 10. A seal 9 is disposed in an internal groove of the sleeve between the sleeve 8 and the control rod 7.

Figure 2A:
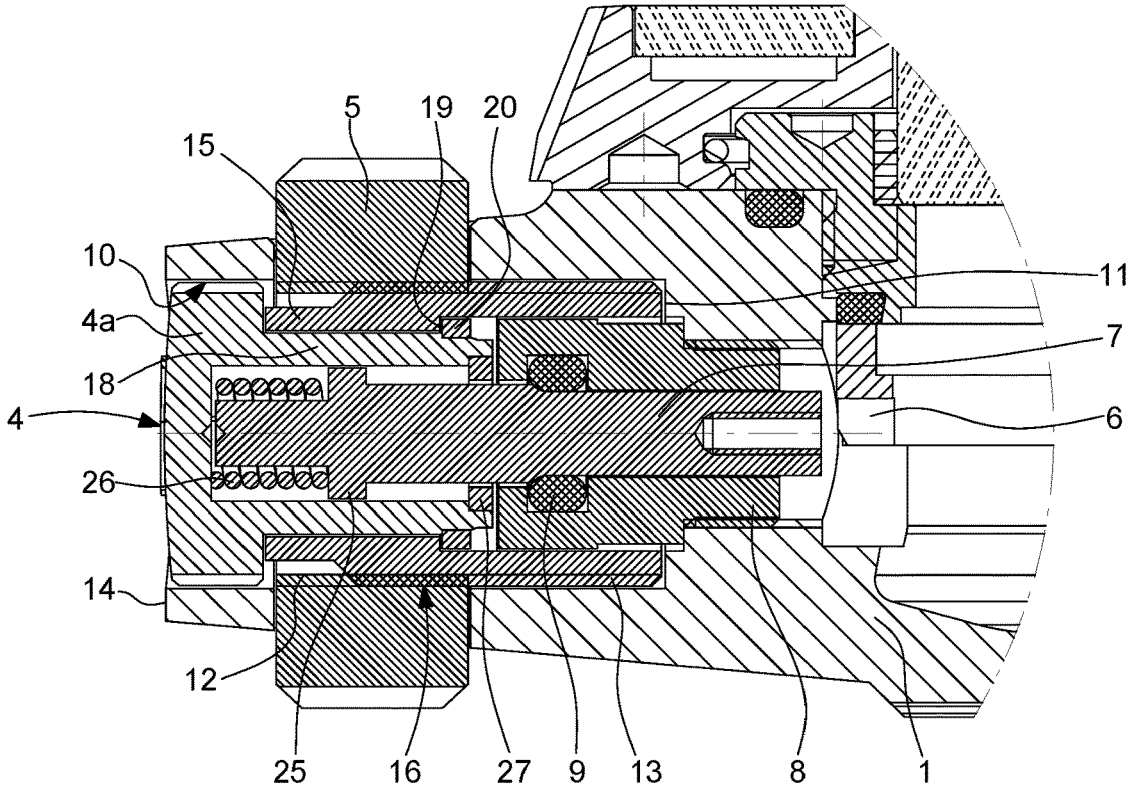
FIGS. 2*a* to 2*d* show 2D sectional views of different positions of the crown, for a watch according to the first embodiment.

As can also be seen in the section of FIG. 2*a* which shows the same position as in FIG. 1, the knurling-roller 5 is disposed around a tube 15 and coupled to this tube 15 by a thread connection 16, so that the rotation of the knurling-roller 5 causes a rotation as well as an axial translation of the tube 15, the tube 15 being coaxial with the central axis 6 of the control rod 7. In the rest position shown in FIG. 2*a*, the tube 15 extends to a shoulder 11 inside the cavity 10. The tube 15 surrounds the sleeve 8, being able to be displaced axially and in rotation relative to the latter. On the other side, the tube 15 surrounds a hollow cylindrical crown body 18 integral with the crown 4. The crown body 18 is also coaxial with the central axis 6. The end of the tube 15 is in contact with the rear face of the crown 4. In its inner median part, the tube 15 is provided with a shoulder 19 against which rests a ring 20 fixed around the distal part of the cylindrical crown body 18. In the axial direction, the crown body 18 and the tube 15 are therefore integral with one another. On the other hand, the crown body 18 is free to rotate relative to the tube 15 and vice versa.

The section of the interior of the hollow cylindrical crown body 18 is non-circular, for example square or having another polygonal shape. The control rod 7 is inserted into the hollow crown body 18 and coupled in rotation to said crown body 18 and therefore to the crown 4, by a portion 25 with a polygonal section, corresponding to the section of the interior of the crown body 18. A compression spring 26 is mounted between the polygonal portion 25 and the bottom of the hollow crown body 18. Said polygonal portion 25 can displace in translation relative to the crown body 18, between two stops, represented on one side by the spring 26, and on the other side by a ring 27 driven against a shoulder formed at the distal end and inside the crown body 18.

Figure 2B:
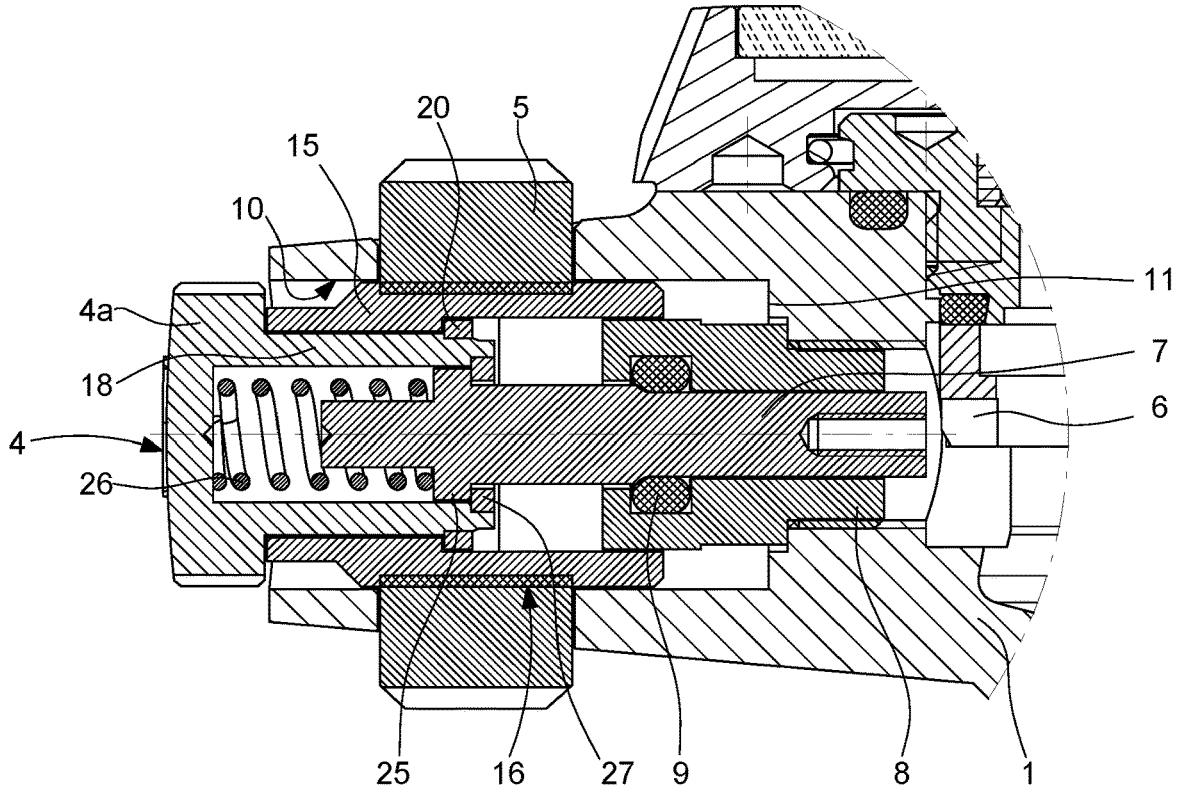

By rotating the knurling-roller 5 manually from the position shown in FIGS. 1 and 2*a*, the user can extract the crown head 4*a* without rotating it. Actuated by the rotation of the knurling-roller 5 via the thread connection 16, the tube 15 displaces outwards by rotating around the central axis 6, and drives the crown body 18 and therefore the crown head 4*a*, which will come out of its housing inside the cavity 10, to reach a first control position projecting from the case 1, as shown in FIG. 2*b*. The crown 4 does not rotate around the central axis 6 during this movement, since it is decoupled in rotation from the tube 15. The control rod 7 remains stationary until the ring 27 contacts the polygonal portion 25 of the rod 7, corresponding to said first control position. The extraction of the crown 4 is also actuated by the spring 26 which relaxes during the movement of the cylinder 18 outwards.

The user can now rotate the crown 4 around its central axis 6, and relative to the tube 15 which remains stationary, causing the rod 7 to rotate, to actuate a first function of the movement, for example the manual winding of said movement.

Figure 2C:
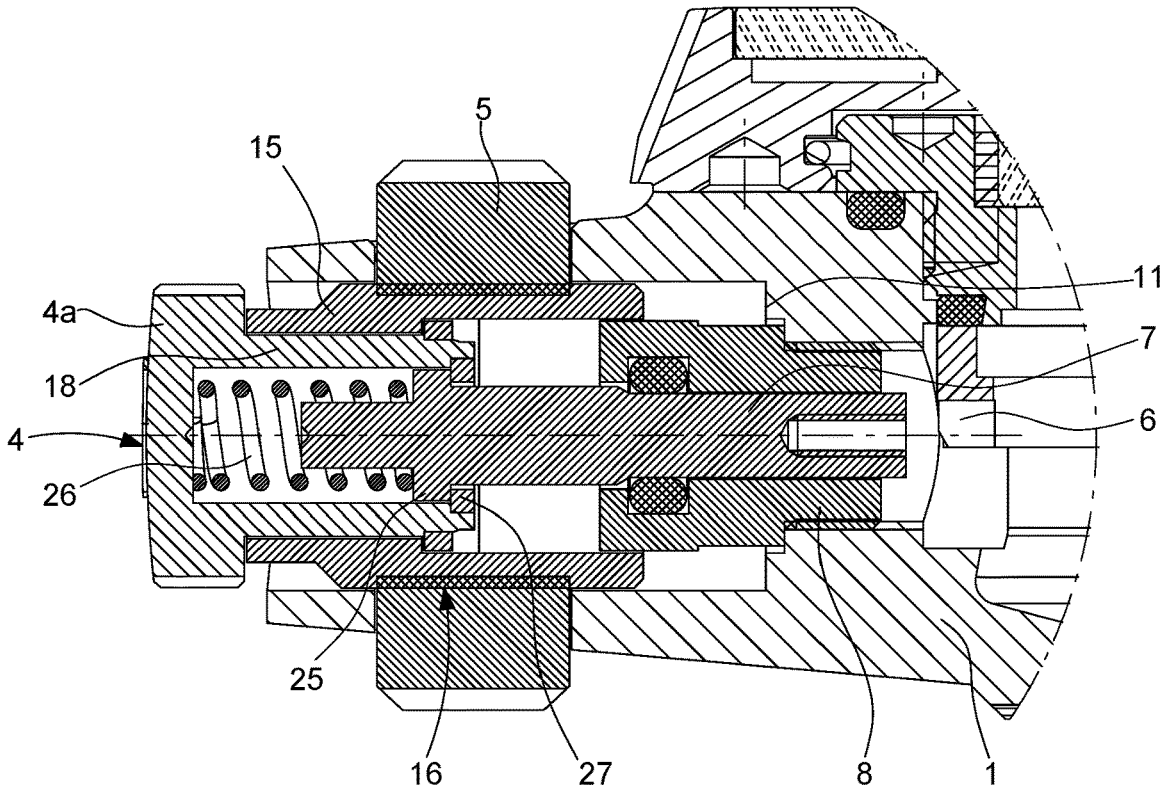

By continuing the rotation of the knurling-roller 5 in the same direction from the first control position, the crown 4 is displaced axially towards a second control position, shown in FIG. 2*c*. Since the ring 27 is now in contact with the polygonal portion 25 of the rod 7, said rod 7 is translated with the crown 4, that is to say the rod 7 is withdrawn from the sleeve 8 to an axial position which allows to actuate a second function, for example adjusting the hour and minutes.

Figure 2D:
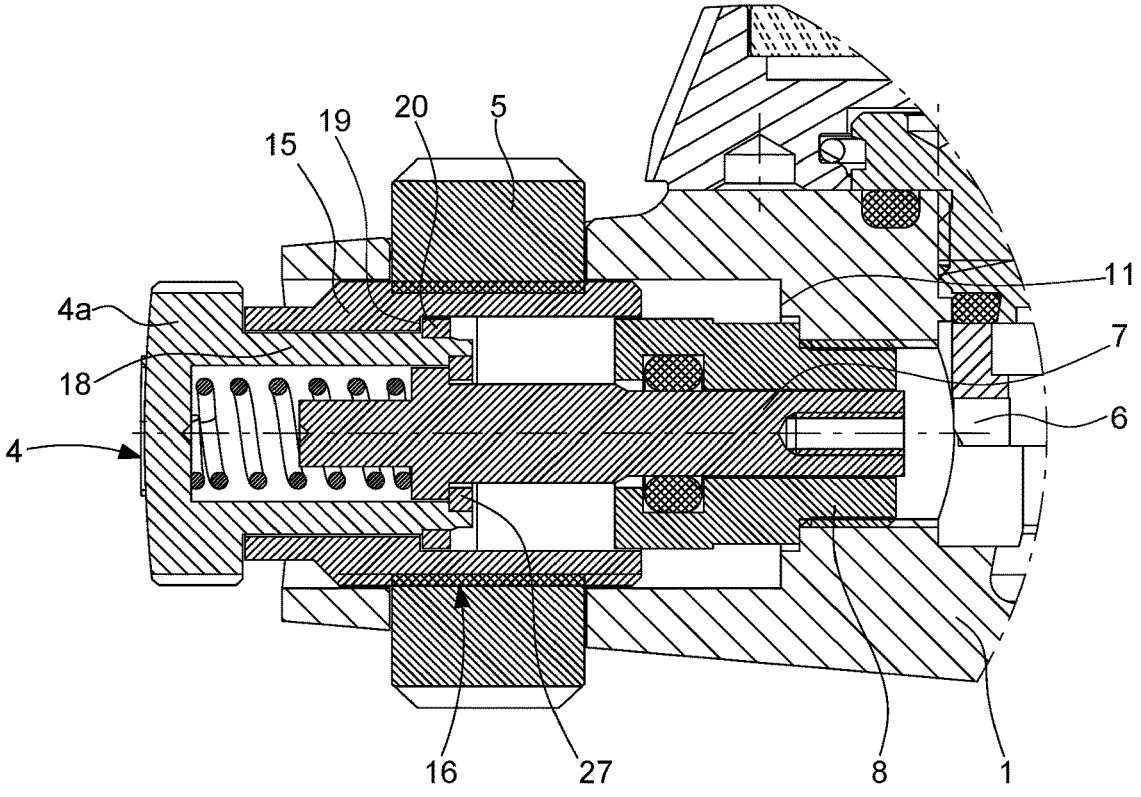
Figure 3A:
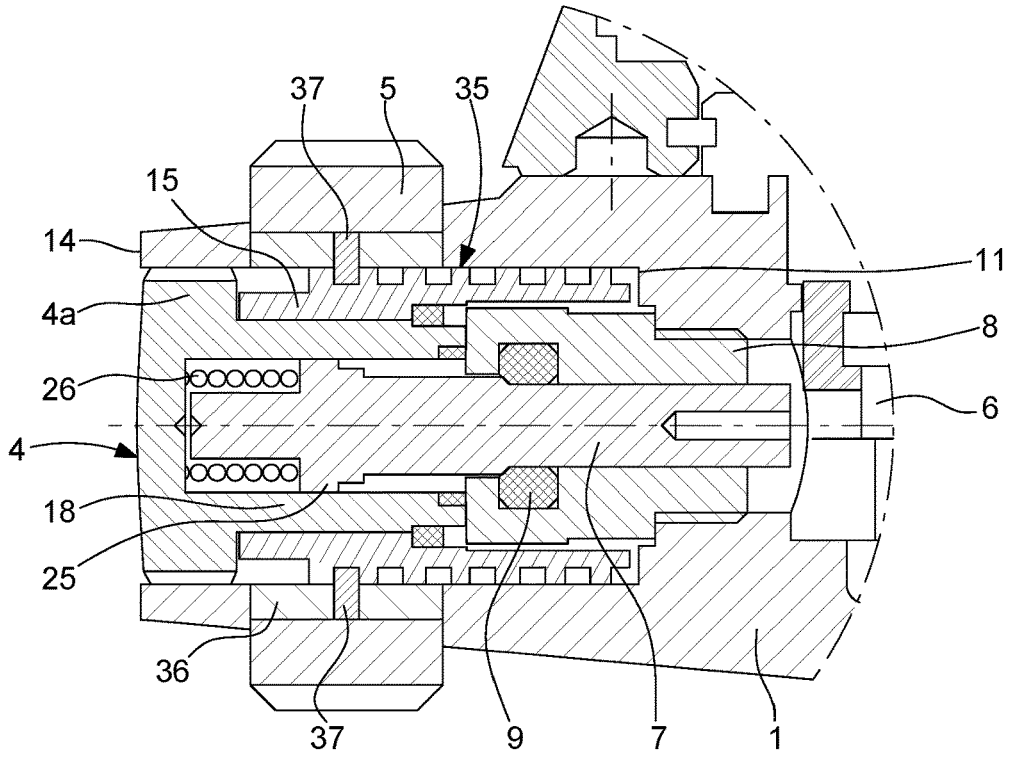
FIGS. 3*a* to 3*d* show 2D sectional views of different positions of the crown, for a watch according to a second embodiment.
Figure 3B:
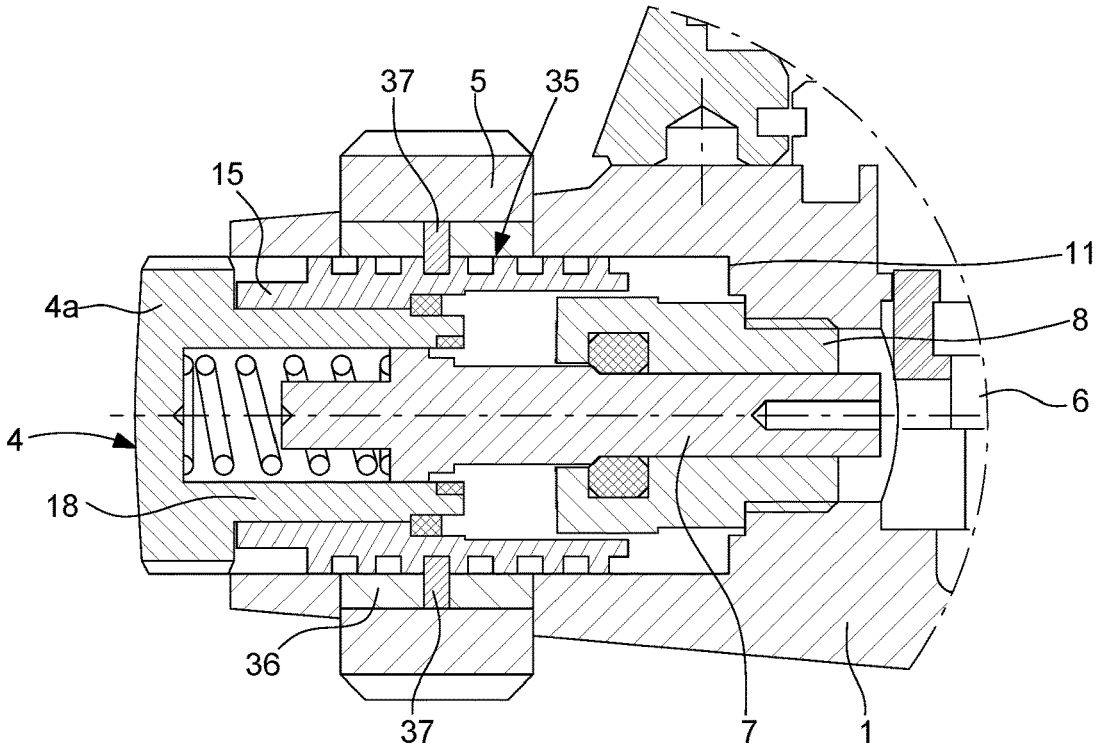
Figure 3C:
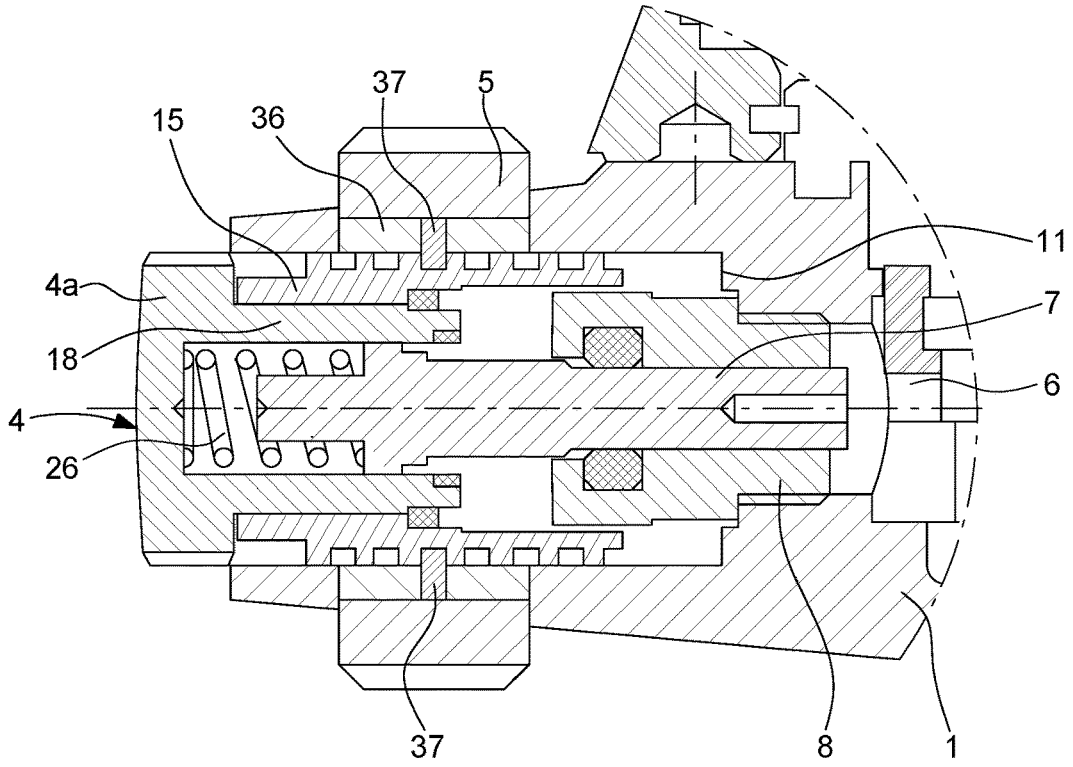
Figure 3D:
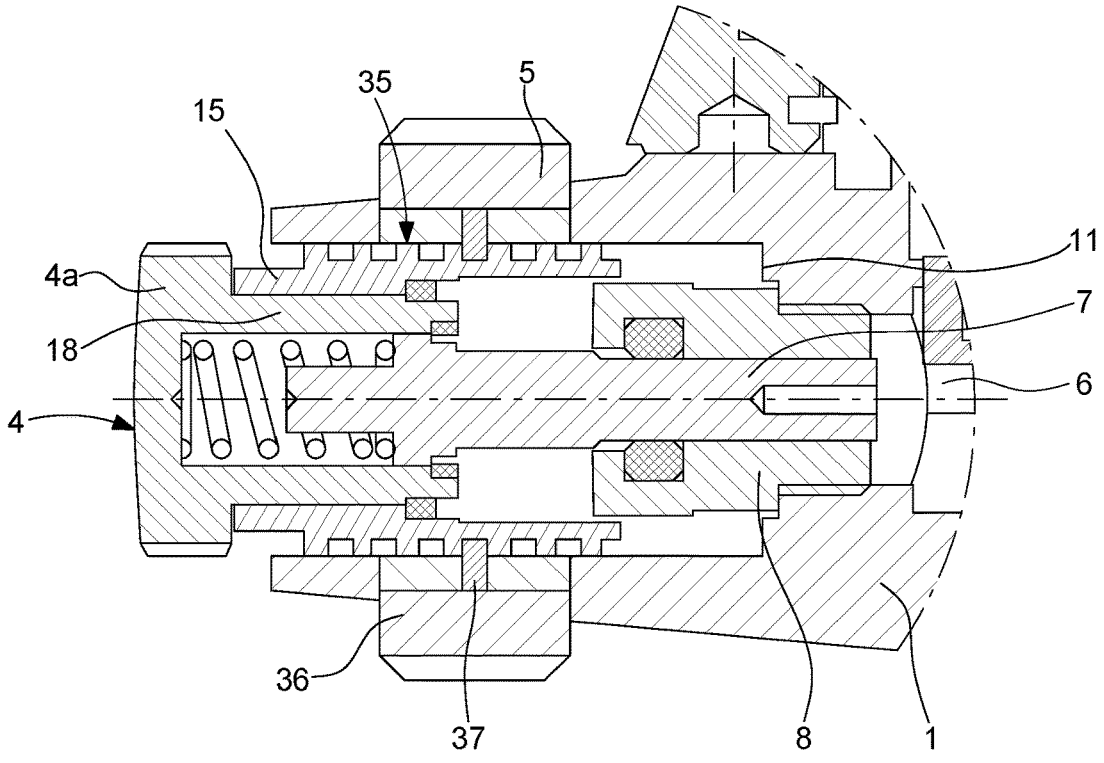
Figure 4A:
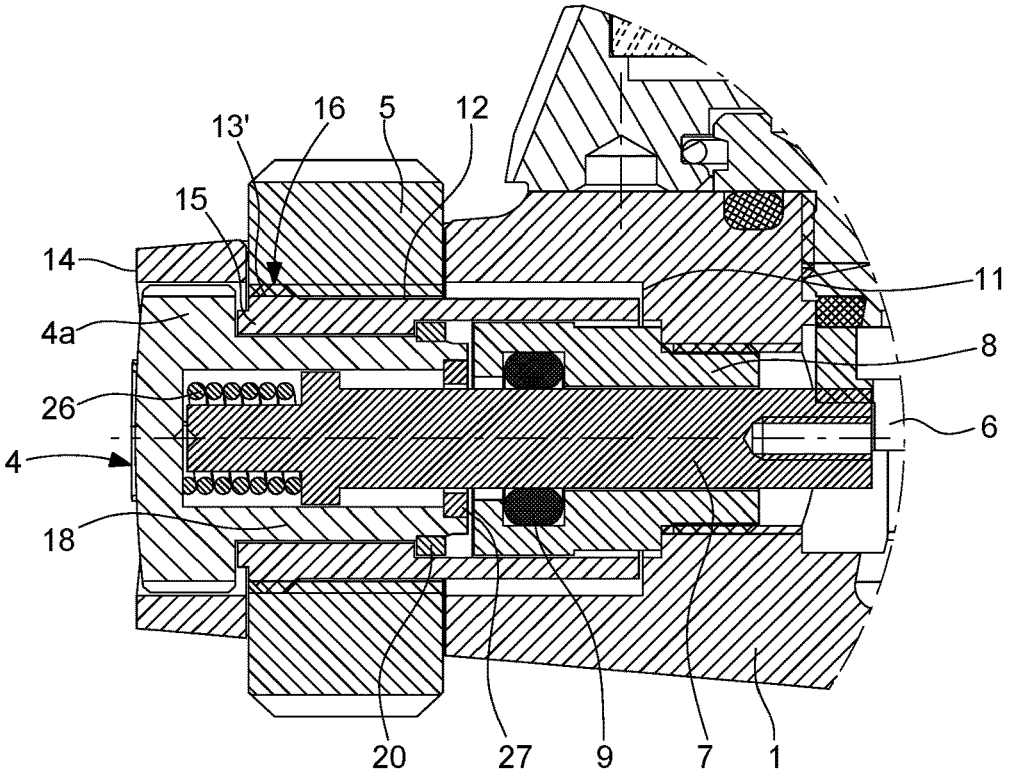
FIGS. 4*a* to 4*d* show 2D sectional views of different positions of the crown, for a watch according to a third embodiment.
Figure 4B:
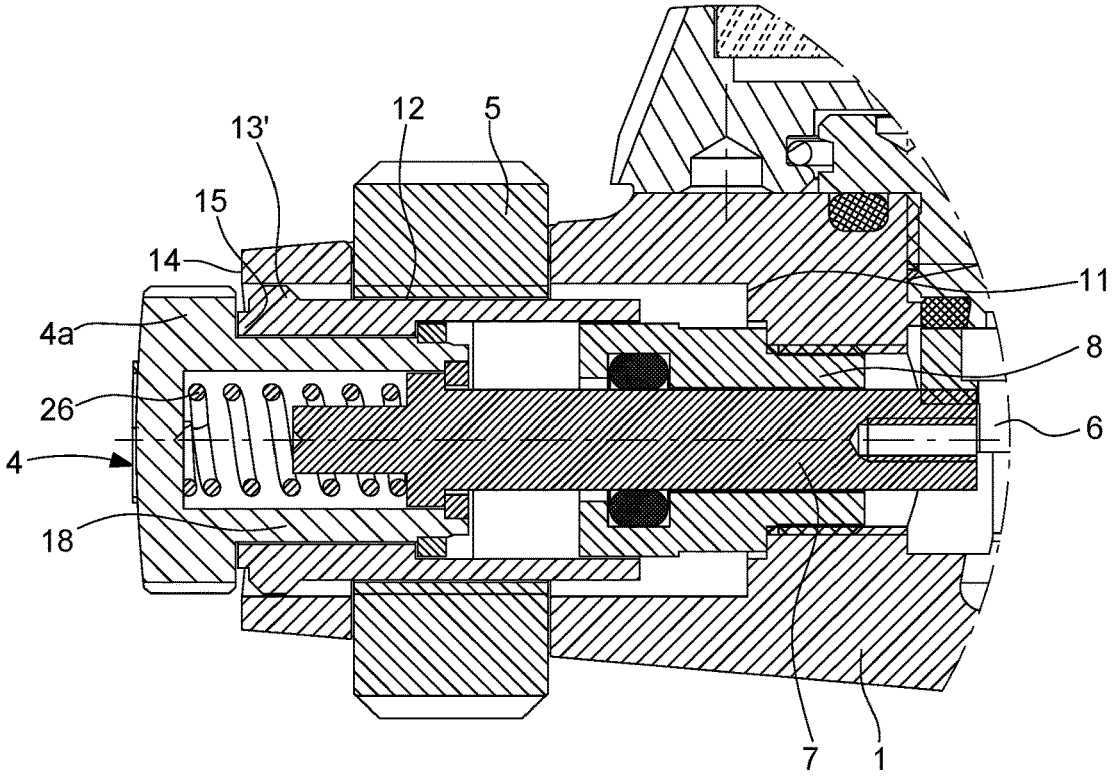
Figure 4C:
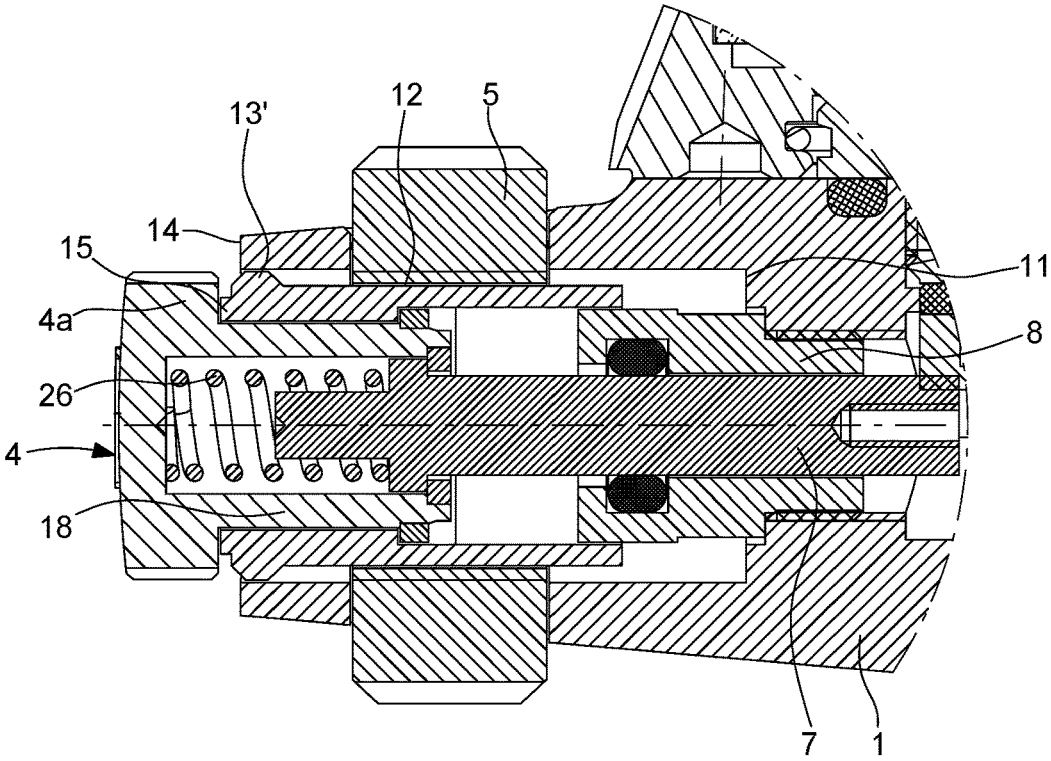
Figure 4D:
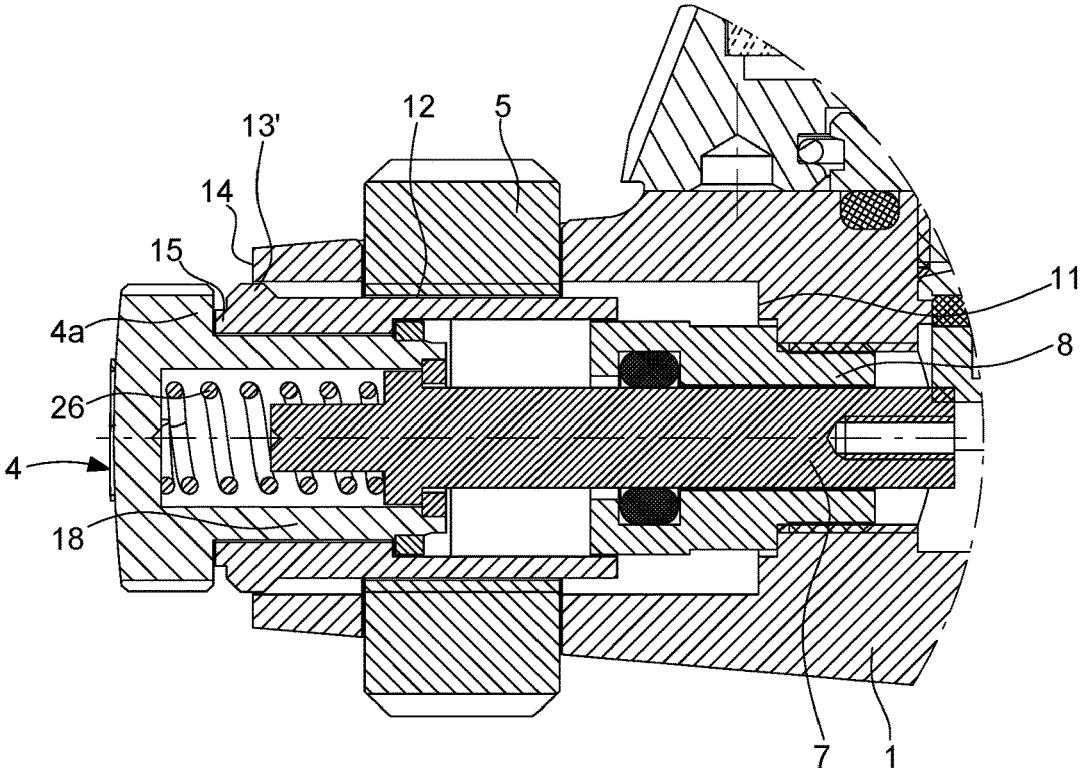

FIG. 2*d* finally shows a third control position of the crown 4, reached by continuing the manual rotation of the knurling-roller 5. The control rod 7 is displaced axially to a position which allows to actuate a third function, for example the adjustment of the date.

To return the crown 4 to its initial rest position (embedded in the case), the user will rotate the knurling-roller 5 in the opposite direction. The tube 15 displaces inwards, and thus drives the crown 4 and the rod 7 via the shoulder 19 and the ring 20. When the rod 7 reaches its initial rest position, the crown 4 continues to displace against the force of the spring 26, until reaching the rest position.

Preferably, one or more markings (not shown) are present on the peripheral or lateral outer surface of the knurling-roller 5. The markings indicate the angular positions of the knurling-roller 5 corresponding to the control positions of the rod 7. Said positions are reached at the moment when the markings of the knurling-roller arrive in front of a marking fixed on the upper surface of the case 1 for example.

It will be noted that the thread connection 16 between the tube 15 and the knurling-roller 5 only represents one embodiment of the coupling between the knurling-roller 5 and the tube 15. When the thread pitch of the connection 16 is small compared to dimensions of the knurling-roller 5, this device requires several rotations of the knurling-roller 5 to reach the first control position and possibly again several rotations to reach the other control positions.

FIGS. 3*a* to 3*d* show a second embodiment of the coupling between the tube 15 and the knurling-roller 5. The tube 15 is now provided with a helical profile 35 on its outer surface, which defines a groove which extends like a helix over the entire outer surface of the tube 15. A shroud 36 is driven inside the central bore of the knurling-roller 5. The shroud 36 maintains a plurality of radial pins 37 which enter the groove with a certain clearance. The pins, typically two in number, are disposed in the same plane perpendicular to the axis 6, preferably in the middle of the length of the knurling-roller 5 (length measured in the direction of the axis 6). The rotation of the knurling-roller 5 thus actuates the rotation and the translation of the tube 15. The advantage of this embodiment is that the axial displacement of the tube 15 to reach the three control positions is now actuated by a rotation over an angular distance of the knurling-roller 5 smaller than in the case in the embodiment described above. Preferably, the pitch of the helix is arranged so that all the axial positions of the crown are reached over a rotation less than one complete revolution of the knurling-roller. Markings on the knurling-roller can also indicate to the user the positions of the knurling-roller 5 corresponding to the control positions of the crown 4 and the rod 7.

In the embodiment of FIGS. 1 and 2*a*-2*d*, the thread connection 16 is made between an internal thread 12 which extends over the entire length (viewed in the direction of axis 6) of the central bore of the knurling-roller 5 and an external thread 13 which extends over the entire length of the tube 15. As a result, the thread connection 16 allows to reach the three control positions and to return the crown 4 to its rest position without losing the coupling between the knurling-roller 5 and the tube 15. The user must therefore neither push nor pull the crown manually, as is the case in existing control devices.

According to another embodiment, the thread connection does not allow all the control positions to be reached, and the user is forced to manually pull the crown to reach a number of additional positions. An example of the latter embodiment is illustrated in FIGS. 4*a*-4*d*. There is also in this embodiment a thread connection 16 between the tube 15 and the knurling-roller 15, however the connection is made in this case between an internal thread 12 over a large part of the length of the central bore of the knurling-roller 5 and an external thread 13' which extends only over a limited part of the length of the tube 15. The threaded connector 16 still allows the crown 4 to come out of its rest position illustrated in FIG. 4*a*, as in the previous embodiments. However, the coupling between the threads 12 and 13' is lost when the crown 4 reaches the first control position, see FIG. 4*b*. To move the crown to its other positions, the user must manually pull the crown 4 out of the case 1, see FIGS. 4*c* and 4*d*, as in existing control devices. To return the crown to the rest position, the user must push the crown 4 back until it returns to the first position until the connection between the knurling-roller and the tube is engaged. Once the thread of the knurling-roller engages with that of the tube, the crown 4 can be returned to its rest position by rotating the knurling-roller 5.

It goes without saying that the scope of the invention includes alternative embodiments which differ from the embodiments described above. For example, the control rod 7 could be integral with the crown 4, so that the rod 7 is extracted as soon as the crown 4 displaces from the rest position. In this case, the cylinder 18 could be a solid cylinder instead of a hollow cylinder, and the spring 26 would be omitted. The number of control positions is not defined and can vary between one and any number achievable for a specific horological movement.

The invention is advantageously applicable to mechanical horological movements with manual winding, but it is also applicable to electronic watches of quartz or other type, in particular electronic watches comprising analogue display members.

The materials used for the various components are preferably metals.

The invention claimed is:

1. A timepiece comprising a case (1), a mechanical or electronic movement disposed in the case, and a crown (4) rotatably coupled to a control rod (7) passing through a wall (14) of the case so as to actuate at least one function of the timepiece by rotation of the control rod around its central axis (6), said rotation being carried out by rotating the crown (4), wherein:

the case (1) is provided with a rotary knurling-roller (5) provided with a bore which is central and coaxial with the central axis (6), and operable in rotation about said central axis, the knurling-roller being mounted on the case (1) so as to be stationary in an axial direction, the crown (4) is integral with a cylindrical crown body (18) disposed inside a tube (15), the crown body and the tube being coaxial with the central axis (6), the tube (15) passes through the bore of the knurling-roller and is coupled to the rotary knurling-roller (5) so that the rotation of the knurling-roller causes a rotation of the tube around the central axis (6), as well as a translation of the tube in the axial direction, the crown (4) is free to rotate relative to the tube (15), the crown is arranged to be integral in translation with the tube in the axial direction, so that the rotation of the knurling-roller (5) causes a translation of the crown (4) in the direction of the central axis (6), the crown (4) being driven by the translation of the tube (15), between a rest position according to which the crown (4) is housed in a cavity (10) provided in said wall (14) of the case (1), and at least one control position according to which the crown (4) is projecting from said wall (14), thus allowing actuation of said at least one function.

2. The timepiece according to claim 1, wherein the knurling-roller (5) and the tube (15) are coupled by a thread connection (16).

3. The timepiece according to claim 2, wherein the thread connection is formed between an internal thread (12) which extends over a length of the central bore of the knurling-roller (5) and an external thread (13) which extends over an entire length of the tube (15) or over part of said length of the tube, thus allowing to reach several control positions without losing a coupling by said thread connection (16) between the tube (15) and the knurling-roller (5).

4. The timepiece according to claim 2, wherein the thread connection (16) is formed between an internal thread (12) which extends at least over part of a length of the central bore of the knurling-roller (5) and an external thread (13') which extends over a limited portion of the length of the tube (15), so that a coupling between the knurling-roller (5) and the tube (15) is lost when the crown (4) reaches one of the control positions from the rest position, and wherein the coupling can be restored by pushing the crown (4) manually towards the inside of the case then by rotationally actuating the knurling-roller.

5. The timepiece according to claim 4, wherein from said control position at which the coupling is lost, the crown (4) can displace into one or more additional axial control positions by manually pulling the crown (4) out of the case (1).

6. The timepiece according to claim 1, wherein:

the tube (15) is provided with a helical profile on its outer surface, said profile defining a groove extending helically along said tube, the knurling-roller (5) is provided with one or more pins (37) oriented radially relative to a surface of the central bore of the knurling-roller (5) and disposed in a single plane perpendicular to the central axis (6), the pins (37) enter said groove, so that the rotation of the knurling-roller (5) in either direction of rotation causes a rotation of the tube (15) as well as a translation of the tube in either axial direction.

7. The timepiece according to claim 6, wherein the pins (37) are mounted in a shroud (36) driven inside the central bore of the knurling-roller (5).

8. The timepiece according to claim 1, wherein the cylinder crown body (18) forms a hollow cylinder with an internal section of polygonal shape, and wherein an end part of the control rod (7) is disposed inside said hollow cylinder (18), said end part of the control rod comprising a portion (25) with a polygonal section corresponding to the internal section of the hollow cylinder (18), and wherein the control rod is disposed so that during the translation of the crown (4) between the rest position and a first control position projecting from the wall, the rod (7) remains stationary relative to the case (1).

9. The timepiece according to claim 8, wherein the control rod (7) is disposed so that when the crown (4) displaces in translation beyond the first control position, the rod (7) is driven with the crown (4) to one or more different control positions.

10. The timepiece according to claim 8, wherein a spring (26) is disposed between a shoulder of the control rod (7) and the crown head (4).

11. The timepiece according to claim 1, wherein the knurling-roller (5) is provided at its outer periphery with one or more markings indicating one or more angular positions of the knurling-roller which correspond respectively to one or more control positions of the rod (7).

12. The timepiece according to claim 1, wherein the timepiece is a wristwatch with mechanical movement and manual winding.

13. The timepiece according to claim 12, wherein the first control position allows manual winding of the movement, and wherein a second control position allows hours and minutes to be adjusted.

14. The timepiece according to claim 1, wherein the crown (4) is flush with the wall of the case (1) when the crown is in the rest position.

15. The timepiece according to claim 1 wherein said wall comprises a through housing extending perpendicularly to the cavity housing the crown wherein said knurling-roller is disposed in said housing.

* * * * *